US006889025B2

(12) United States Patent
Kyung

(10) Patent No.: US 6,889,025 B2
(45) Date of Patent: May 3, 2005

(54) COLOR IMAGE FORMING APPARATUS HAVING DEVELOPERS IN A FIXED POSITION WITH RESPECT TO A PHOTOSENSITIVE MEDIUM

(75) Inventor: Myung-ho Kyung, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 61 days.

(21) Appl. No.: 10/393,256

(22) Filed: Mar. 21, 2003

(65) Prior Publication Data

US 2004/0005172 A1 Jan. 8, 2004

(30) Foreign Application Priority Data

Jul. 2, 2002 (KR) ..... 2002-38050

(51) Int. Cl.[7] ..... G03G 15/01
(52) U.S. Cl. ..... 399/228; 399/223

(58) Field of Search ..... 399/98, 223, 228, 399/234, 235, 298, 299, 302

(56) References Cited

U.S. PATENT DOCUMENTS

| | | | | | |
|---|---|---|---|---|---|
| 4,939,547 | A | * | 7/1990 | Miyaji et al. | 399/228 |
| 5,376,998 | A | * | 12/1994 | Suzuki | 399/228 X |
| 5,585,898 | A | * | 12/1996 | Fujii | 399/228 |
| 5,862,438 | A | * | 1/1999 | Folkins | 399/223 X |
| 6,183,926 | B1 | * | 2/2001 | Kuroda et al. | 399/223 X |
| 6,259,879 | B1 | * | 7/2001 | Bisaiji | 399/302 X |
| 6,263,178 | B1 | * | 7/2001 | Takeyama et al. | 399/228 |
| 6,285,841 | B1 | * | 9/2001 | Miho | 399/223 X |

* cited by examiner

*Primary Examiner*—Sandra L. Brase
(74) *Attorney, Agent, or Firm*—Staas & Halsey LLP

(57) ABSTRACT

A color image forming apparatus includes a photosensitive medium and developers in a fixed position, each having a developing gap with respect to the photosensitive medium to consecutively develop an image with color toners.

19 Claims, 4 Drawing Sheets

COLOR IMAGE FORMING APPARATUS HAVING DEVELOPERS IN A FIXED POSITION WITH RESPECT TO A PHOTOSENSITIVE MEDIUM

CROSS-REFERENCE TO RELATED APPLICATIONS

This application claims the priority of Korean Patent Application No. 2002-38050, filed Jul. 2, 2002 in the Korean Intellectual Property Office, the disclosure of which is incorporated herein by reference.

BACKGROUND OF THE INVENTION

1. Field of the Invention

The present invention relates to an image forming apparatus, and more particularly, to an electrophotographic color image forming apparatus.

2. Description of the Related Art

Generally, an electrophotographic image forming apparatus prints a desired image in a manner that a toner is supplied to a photosensitive medium where an electrostatic latent image is formed, to form a toner image. The toner image is then transferred to a printing paper. Meanwhile, the electrophotographic color image forming apparatus forms a visible color image on the photosensitive medium by developing the electrostatic latent image formed on the photosensitive medium by supplying four colors of toners consecutively.

FIG. 1 shows an example of a conventional electrophotographic color image forming apparatus.

Referring to FIG. 1, the conventional color image forming apparatus includes a photosensitive drum 10 having a layer to be electrically charged and generating an electric potential difference at an electrically charged area when the layer is exposed to a light source, a charging unit 20 to electrically charge the photosensitive drum 10, a laser scanning unit 30 to convert an electric signal of image data to be formed to an optical signal and projecting the converted signal to the photosensitive drum 10 such that the electrostatic latent image is formed on the photosensitive drum 10 by the electric potential difference. A developing unit 40 in the conventional color image forming apparatus develops the electrostatic latent image by supplying toners of different colors consecutively, a transferring unit 50 transfers the toner image formed on the photosensitive drum 10 to the printing paper P, a fusing unit 60 fixes the toner image to the printing paper P and a paper feeding unit 70 feeds the printing paper P.

The developing unit 40 includes four developers 42, 43, 44, and 45 to develop the electrostatic latent image of the photosensitive drum 10 by supplying the photosensitive drum 10 with toners of yellow, magenta, cyan, and black, consecutively. The respective developers 42, 43, 44, and 45 include toner containers 46 to contain the color toners, developing rollers 47 to supply the color toners contained in the toner containers 46 to the electrostatic latent image area of the photosensitive drum 10, and gap rings 48 to maintain gaps between the developing rollers 47 and the photosensitive drum 10. Also, the respective developers 42, 43, 44, and 45 are disposed along a circular turret 41 with a distance apart from one another, and they close to the photosensitive drum 10 one by one, consecutively, when the turret 41 rotates to develop the electrostatic latent image of the photosensitive drum 10 with the respective color toners.

The transferring unit 50 includes a transfer belt 51 as a moving medium by which the toner mage formed on the photosensitive drum 10 is carried, a first transfer roller 52 to transfer the toner image from the photosensitive drum to the transfer belt 51, and a second transfer roller 53 to transfer the toner image from the transfer belt 51 to the printing paper P.

The conventional electrophotographic color image forming apparatus, as constructed above, forms the electrostatic latent image on the photosensitive drum 10 by projecting a laser beam from the laser scanning unit 30 into the photosensitive drum 10, which is electrically charged to a predetermined electric potential by the charging unit 20.

Subsequently, the electrostatic latent image is developed by the developing unit 40. Typically, the respective developers 42, 43, 44 and 45 approach the photosensitive drum 10 by an order of yellow, magenta, cyan and black as the turret 41 rotates to develop the electrostatic latent image. At this point, when the developing roller 47 of one developer approaches the photosensitive drum 10 with the gap with respect to the photosensitive drum 10, the toner is jumped onto the photosensitive drum 10 by an electrostatic force that is generated by the electric potential difference between the photosensitive drum 10 and the developing rollers 47. The developing roller 47 can maintain the gap with respect to the photosensitive drum 10 using the pair of gap rings 48 disposed at both sides of the developing roller 47.

Visible color images formed on the photosensitive drum 10 by the above develop processing are overlapped on the transfer belt 51, and the image on the transfer belt 51 is transferred to the printing paper P passing between the transfer belt 51 and the second transfer roller 53.

The printing paper P where the image is transferred, passes through the fusing unit 60 to fix the image to the printing paper P and then, the printing paper P is fed out.

However, the conventional electrophotosenstive color image forming apparatus has a problem of noise caused due to the developing unit 40 that is operated using a developer moving method. That is, when the respective developers 42, 43, 44, and 45 approach the photosensitive drum 10 as the turret 41 rotates, the gap rings 48 of the developers come into contact with a surface of the photosensitive drum 10 causing the noise problem.

Also, a shock occurs when the gap rings 48 of the developers come into contact with the photosensitive drum 10, which is transferred to the photosensitive drum 10, thereby deteriorating the toner image formed on the photosensitive drum 10 to be transferred from the photosensitive drum 10 to the transfer belt 51. Accordingly, a problem of image quality deterioration occurs in the conventional electrophotsensitive color image forming apparatus.

SUMMARY OF THE INVENTION

Various aspects and advantages of the invention will be set forth in part in the description that follows and, in part, will be obvious from the description, or may be learned by practice of the invention.

In accordance with an aspect of the present invention, there is provided a color image forming apparatus capable of solving noise problems and lowered image quality usually caused in a conventional developer moving method by providing developers that consecutively perform a developing with color toners in a fixed state having a developing gap with respect to a photosensitive drum.

In accordance with an aspect of the present invention, there is provided a color image forming apparatus capable of preventing a contamination of a developing roller of a non-operated developer and a contamination of an electrostatic latent image of a photosensitive drum that occur in the conventional developer moving method.

In accordance with an aspect of the present invention, there is provided a color image forming apparatus including: a light source; a photosensitive medium having a layer to be electrically charged and upon exposure to the light source, an electric potential difference is generated at an electrically charged area of the layer; a light exposure unit converting an electrical signal of an image data to be formed to an optical signal and projecting the converted optical signal to the photosensitive medium to form an electrostatic latent image by utilizing the electric potential difference; a developing unit comprising four developers each having developing rollers and toner-supplying rollers to develop the electrostatic latent image on the photosensitive medium with color toners, wherein the developers are fixed near to the photosensitive medium where each developing roller maintains a predetermined developing gap with respect to the photosensitive medium; a high voltage switching unit supplying the developing rollers and the toner-supplying rollers with a high voltage that is required during a developing operation, the high voltage being consecutively supplied to each of the developers in an order of colors where the development of the electrostatic image is performed consecutively in respective colors; and a plus voltage-supplying unit supplying the photosensitive medium with a plus(+) voltage to reduce an electric potential difference between the photosensitive medium and the developing rollers of non-operated developers during the developing operation, wherein a toner image and/or the electrostatic image of different colors formed on the photosensitive medium is not attracted to the developing rollers of the non-operated developers.

According to an aspect of the present invention, each developer of the developing unit comprises a pair of gap rings connected to a shaft of the developing roller and contacting to the photosensitive medium to maintain the predetermined developing gap between the photosensitive medium and the developing roller.

Furthermore, according to an aspect of the present invention, the color image forming apparatus includes: a transferring unit including a transfer belt as a moving medium of the toner image formed on the photosensitive medium, a first transfer roller transferring the toner image formed on the photosensitive medium to the transfer belt, and a second transfer roller transferring the toner image transferred to the transfer belt to a printing paper; a fusing unit comprising a pair of transfer rollers to fix the toner image transferred to the printing paper by utilizing heat and pressure; and a paper feeding unit supplying the printing paper to the transferring unit.

According to an aspect of the present invention, because the respective developers supply color toners consecutively with a fixed state for the developing operation, the problems of noise generation, and poor development and transfer due to a periodical contact of the photosensitive medium and a developing roller can be solved, and accordingly, higher image quality is guaranteed.

Furthermore, according to an aspect of the present invention, because the photosensitive medium is supplied with a predetermined plus voltage, an electric potential between the photosensitive medium and a non-operated developer is reduced. Thus, once formed on the photosensitive medium, a toner image is not attracted to a developing roller such that the developing roller is prevented from contamination. Also, because the electrostatic latent image formed on the photosensitive medium is not contaminated by the non-operated developing roller, a higher image quality can be guaranteed.

In accordance with an aspect of the present invention, there is provided a color image forming apparatus, including: a photosensitive medium; and developers in a fixed position, each having a developing gap with respect to the photosensitive medium to consecutively develop an image with color toners.

These together with other aspects and advantages which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and other aspects and advantages of the invention will become apparent and more readily appreciated from the following description of the embodiments, taken in conjunction with the accompanying drawings of which.

DETAILED DESCRIPTION OF THE PREFERRED EMBODIMENT

Figure 1:
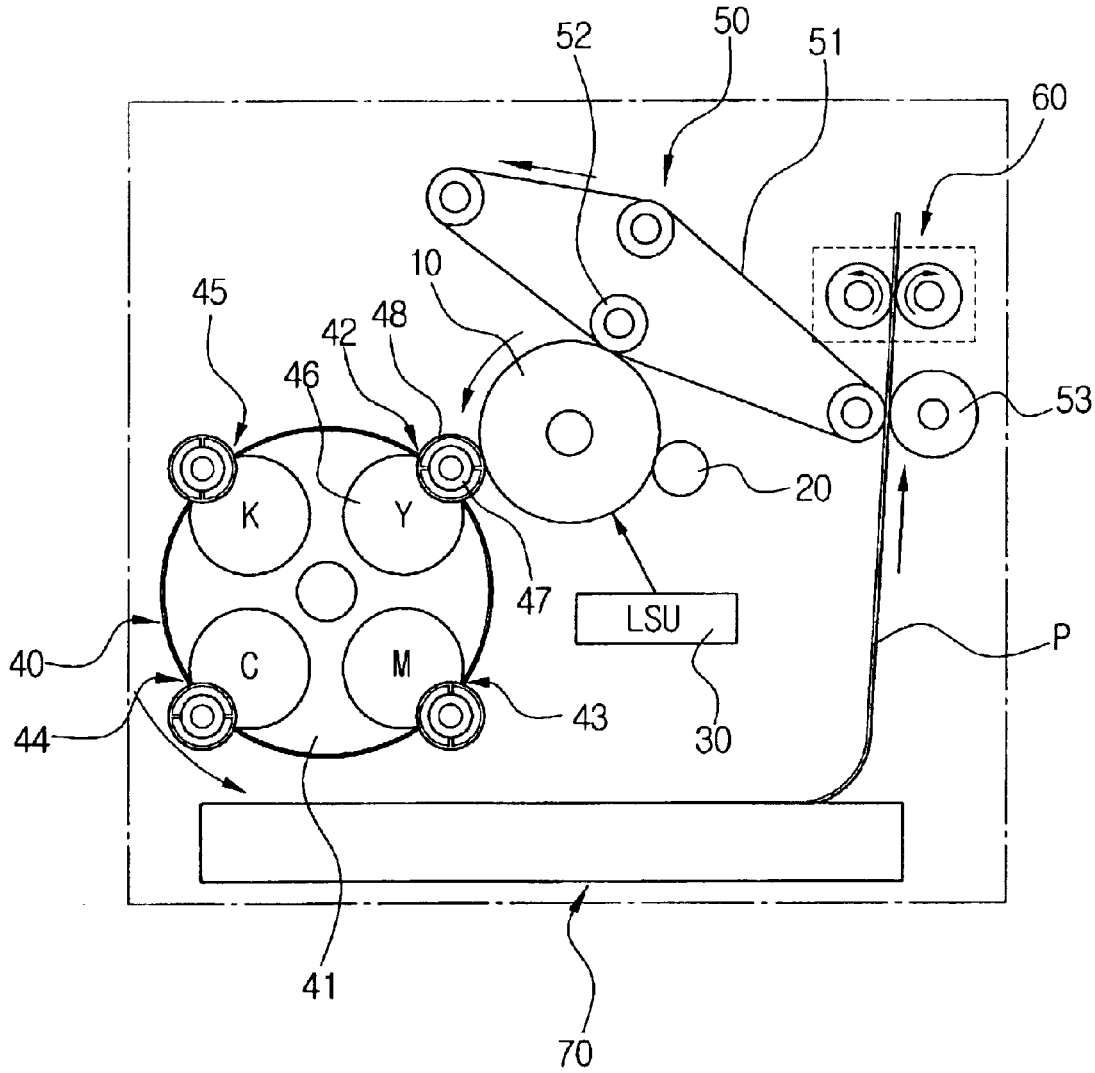
FIG. 1 (PRIOR ART)
FIG. 1 is a schematic view showing a conventional color image forming apparatus.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
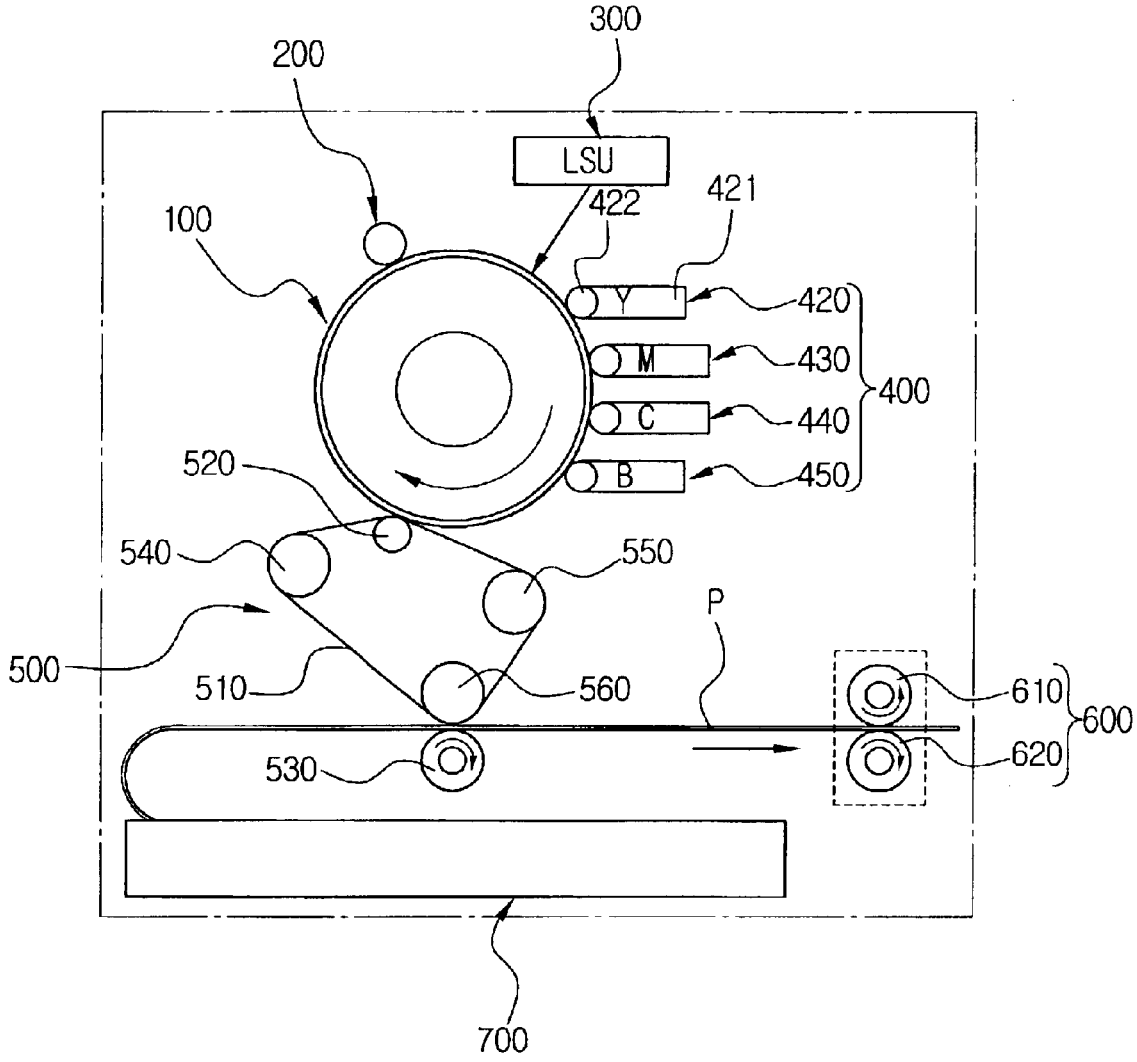
FIG. 2 is a view showing a color image forming apparatus according to an aspect of the present invention.
Figure 3:
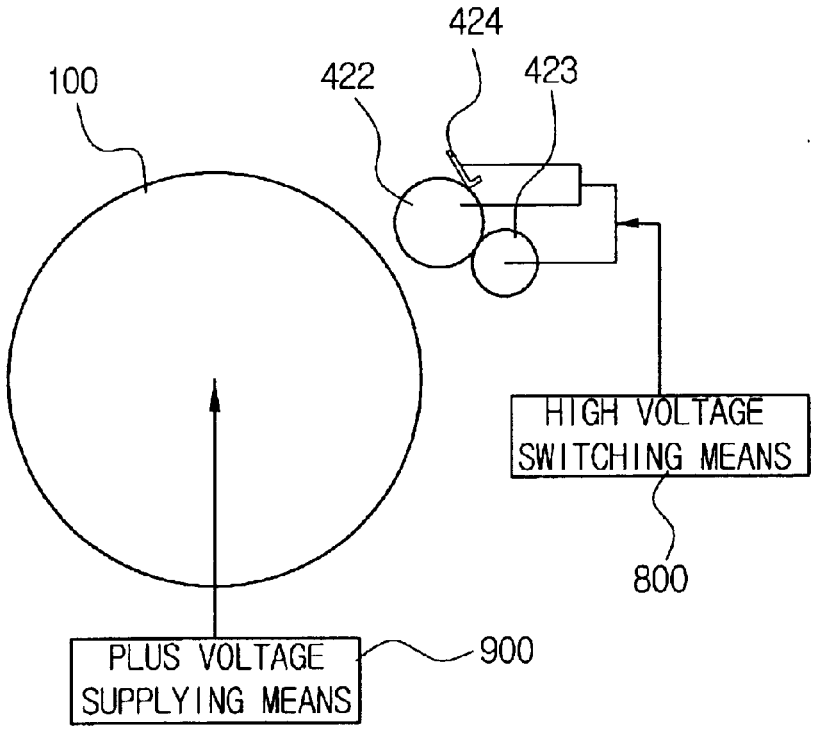
FIG. 3 is a view showing a main part of the color image forming apparatus, according to an aspect of the present invention.

Referring FIGS. 2 and 3, a color image forming apparatus, according to an aspect of the present invention, includes a photosensitive medium 100, a charging unit 200, a laser scanning unit 300, a developing unit 400, a transferring unit 500, a fusing unit 600, a paper feeding unit 700, a high voltage switching unit 800 and a plus voltage supplying unit 900.

The photosensitive medium 100 has a layer to be electrically charged and is formed as a rotary body having a drum shape. However, the shape of the photosensitive medium 100 is not limited to the drum shape, and therefore, other various shapes and structures such as a belt shape are possible. The photosensitive medium 100 forms a predetermined electrostatic latent image by utilizing an electric potential difference that occurs at an electrically charged area charged by the laser scanning unit 300.

The charging unit 200 electrically charges the photosensitive medium 100 to a predetermined electric potential. Generally, the photosensitive medium 100 is electrically charged approximately with −700V.

The laser scanning unit 300 converts an electrical signal of image data to be formed into an optical signal and projects the converted optical signal to the photosensitive medium 100, whereby the electrostatic latent image is formed on the photosensitive medium 100 by the electric potential.

The developing unit 400 develops the electrostatic latent image formed on the photosensitive medium 100 by using color toners to form a visible color image on the photosensitive medium 100. The developing unit 400 includes four developers 420, 430, 440 and 450 that respectively correspond to yellow, magenta, cyan, and black toners. The developer 420, which will be described as a representative example of the developers 420, 430, 440, 450, includes a toner container 421, a developing roller 422, a toner-supplying roller 423, a control blade 424, and a gap ring (not shown).

The toner container 421 contains one of the color toners, and the developing roller 422 is rotatably disposed at an opening of the toner container 421. The toner-supplying roller 423 is disposed to contact with the developing roller 422. Accordingly, the toner in the toner container 421 is supplied to the developing roller 422. The control blade 424 is to maintain a predetermined depth of a toner layer formed on the developing roller 422. Meanwhile, the gap ring is connected to both ends of a shaft of the developing roller 422, and contacts with the photosensitive medium 100 to allow the photosensitive medium 100 and the developing roller 422 to maintain a predetermined gap therebetween. Although the gap ring is not necessarily required, an employment thereof may guarantee the predetermined gap to be changed by an external shock.

Meanwhile, the four developers 420, 430, 440, and 450 are fixed to have the developing rollers 422 maintain the predetermined gap with respect to the photosensitive medium 100. That is, the four developers 420, 430, 440, and 450 are fixed to have the predetermined gap with respect to the photosensitive medium 100. The four developers 420, 430, 440, and 450 develop the image data using a developing voltage supplied thereto consecutively in an order of colors, which will be described hereinbelow.

The transferring unit 500 to transfer the visible color image developed on the photosensitive medium 100 with the toners of the developing unit 400 to the printing paper P, includes a transfer belt 510, a first transfer roller 520 and a second transfer roller 530. The transfer belt 510 encloses a plurality of guide rollers 540, 550, and 560 that serve as a moving medium to carry the toner image of the photosensitive medium 100. The first transfer roller 520 is disposed inside the transfer belt 510 to contact with the photosensitive medium 100, to transfer the image of the photosensitive medium 100 to the transfer belt 510. The second transfer roller 530 is disposed to contact with the guide roller 560 and allow the printing paper P to pass between the second transfer roller 530 and the guide roller 560. The second transfer roller 530 is to transfer the image transferred to the transfer belt 510 to the printing paper P. The fusing unit 600 includes a pair of fixing rollers 610 and 620, to fix the image to the printing paper P by utilizing heat and pressure. The paper feeding unit 700 supplies the printing paper P to the transferring unit 500.

The high voltage switching unit 800 of FIG. 3 supplies high voltages that are necessary to operate the respective developers 420, 430, 440 and 450 during a developing process of the developing unit 400. Accordingly, the developers 420, 430, 440 and 450 are consecutively operated in a predetermined order to supply the color toners in the predetermined order to the photosensitive medium 100 to form the color image. For the more detailed descriptions, the high voltage switching unit 800, according to an aspect of the present invention, supplies the high voltage to the developing roller 422 and the toner supplying roller 423 of the developer 420 that is in a developing operation and simultaneously blocks the high voltage from flowing into the other three developers 430, 440 and 450 that are not in the developing operation. According to the above high voltage switching operation, the developing process is performed in the predetermined order of colors, i.e., yellow, magenta, cyan and black. As described above, the color image forming apparatus, according to an aspect of the present invention, can develop each color image consecutively without moving the developers. Accordingly, an aspect of the present invention can prevent noise, development deterioration, and transfer deterioration usually caused in a conventional developer moving method where the photosensitive medium and the developing roller contact with each other periodically.

Furthermore, the plus voltage supplying unit 900 supplies a predetermined plus voltage to the photosensitive medium 100 during the developing operation. Due to the plus voltage, the electric potential difference occurring between the photosensitive medium 100 and a developing roller of one of the developers 420, 430, 440, and 450, for instance, in contact with the photosensitive medium 100 but not in the developing operation, is lower than an electric potential difference occurring in a conventional color image forming apparatus in which a photosensitive medium is grounded. Accordingly, once formed on the photosensitive medium 100, the toner image is not attracted to the developing roller of the non-operated developer. Also, when the plus voltage supplying unit 900 supplies the predetermined plus voltage to the photosensitive medium 100, a remaining toner of the developing roller of the non-operated developer is not attracted to the photosensitive medium 100 while another developer is in the developing process. Accordingly, the electrostatic latent image of the photosensitive medium 100 is not contaminated and, thus, more stable quality of the image can be obtained. Such will be described with reference to FIG. 4 and FIG. 5.

Figure 4:
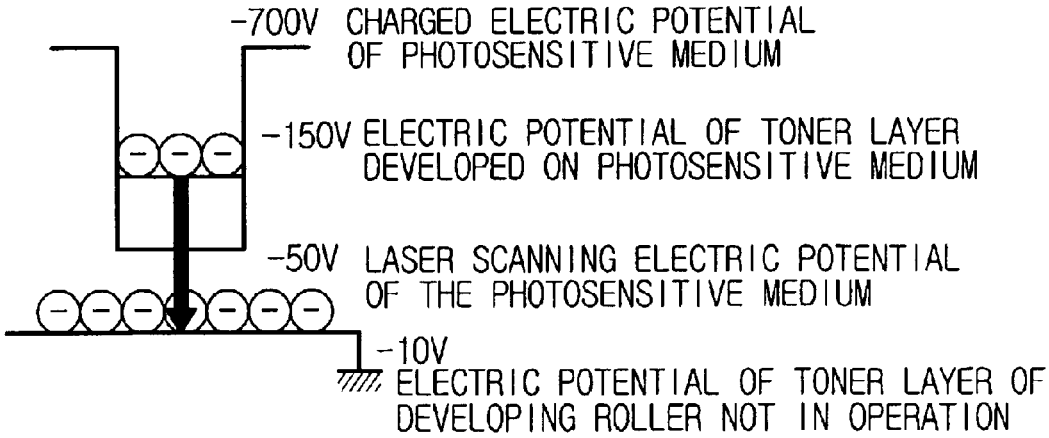
FIGS. 4 and 5 are views showing an electrical potential difference occurring between a photosensitive medium and a developing roller when the color image forming apparatus of the present invention performs a developing method, according to an aspect of the present invention, in comparison to a developing method of the conventional color image forming apparatus.
Figure 5:
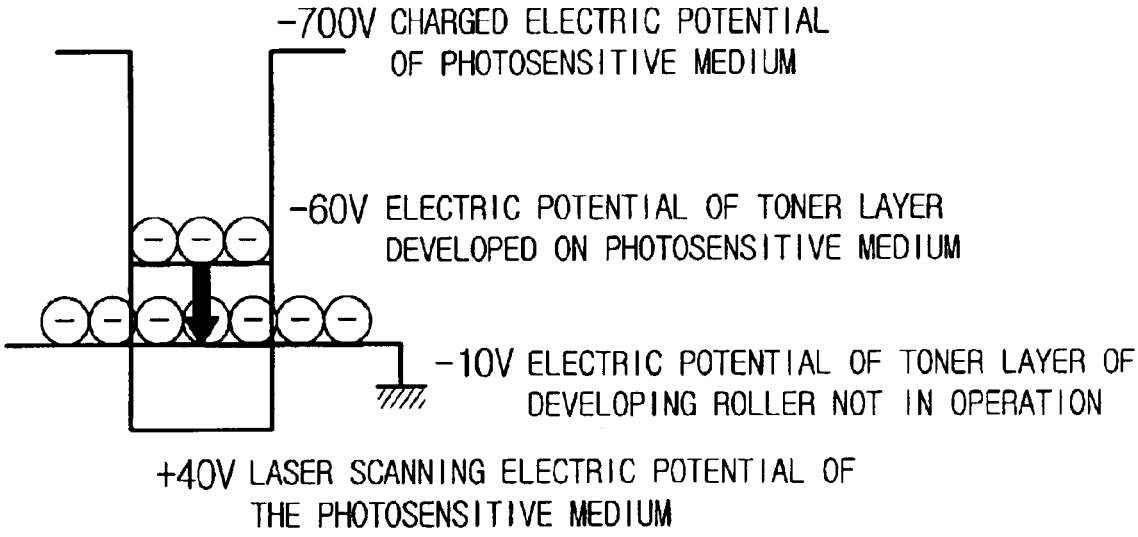

FIG. 4 shows a level of voltages of a photosensitive medium 100 and a developing roller when the image forming apparatus is in the developing operation with the photosensitive medium being grounded. FIG. 5 shows the level of voltages of the photosensitive medium 100 and one of the developing rollers of the image forming apparatus, according to an aspect of the present invention, when the image forming apparatus is in the developing operation with the photosensitive medium 100 being supplied with the plus voltage of +90V.

As shown in FIGS. 4 and 5, while in FIG. 4 the electric potential of the toner layer developed on the photosensitive medium 100 maintains −150V, the present invention maintains −60V because the voltage of +90V is supplied to the photosensitive medium 100. At this time, the electric potential of the toner layer of the developing roller of the non-operated developer is maintained −10V in both cases. The electrical potential difference between the toner layer developed on the photosensitive medium and the developing roller of the non-operated developer becomes narrower in FIG. 5, which is shown with an arrow. That is, the level and the directionality of force exerted to the toner layer developed on the photosensitive medium to be attracted to the non-operated developer of FIG. 5 becomes smaller than that of FIG. 4, such that the developing roller of the non-operated developer is prevented from contamination.

Additionally, when the photosensitive medium 100 is supplied with the plus voltage, a laser scanning electric potential of the photosensitive medium increases from −50V to +40V such that the electric latent image formed on the photosensitive medium is prevented from being contaminated by the non-operated developing roller. Because the laser scanning electric potential of the grounded photosensitive medium of FIG. 4 is maintain ed at −50V, there is a possibility that remaining toner of the non-operated developers is attracted to the photosensitive medium and, thus, contaminates the electrostatic latent image of the photosensitive medium. According to an aspect of the present invention, because the laser scanning electric potential of the photosensitive medium 100 is maintain ed at +40V, the remaining toner of the non-operated developing roller is not attracted to the photosensitive medium 100. Accordingly, the electrostatic latent image of the photosensitive medium 100 can be prevented from being contaminated and, thus, more stable quality of the image can be obtained.

According to an aspect of the present invention as described above, because the developers supply the color toners consecutively in the fixed state during the developing operation, the problems of noise generation, and poor development and transfer of the image due to the periodical contact of the photosensitive medium 100 and one of the developing rollers, for instance, can be solved, and accordingly, higher image quality is guaranteed.

Furthermore, according to an aspect of the present invention, because the photosensitive medium is supplied with the predetermined plus voltage, the electric potential between the photosensitive medium and the non-operated developer is reduced. Thus, once formed on the photosensitive medium, the toner image is not attracted to the developing roller, for instance, such that the developing roller is prevented from contamination. Also, because the electrostatic latent image formed on the photosensitive medium is not contaminated by the non-operated developing roller, the higher image quality can be guaranteed.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A color image forming apparatus, comprising:

a light source;

a photosensitive medium having a layer to be electrically charged and upon exposure to the light source, an electric potential difference is generated at an electrically charged area of the layer;

a light exposure unit converting an electrical signal of an image data to be formed to an optical signal and projecting the converted optical signal to the photosensitive medium to form an electrostatic latent image by utilizing the electric potential difference;

a developing unit comprising developers each having developing rollers and toner-supplying rollers to develop the electrostatic latent image on the photosensitive medium with color toners, wherein the developers are fixed near to the photosensitive medium where each developing roller maintains a predetermined developing gap with respect to the photosensitive medium;

a high voltage switching unit supplying the developing rollers and the toner-supplying rollers with a high voltage that is required during a developing operation, the high voltage being consecutively supplied to each of the developers in an order of colors where the development of the electrostatic image is performed consecutively in respective colors; and a plus voltage-supplying unit supplying the photosensitive medium with a plus(+) voltage to reduce an electric potential difference between the photosensitive medium and the developing rollers of non-operated developers during the developing operation, wherein a toner image and/or the electrostatic image of different colors formed on the photosensitive medium is not attracted to the developing rollers of the non-operated developers.

2. The color image forming apparatus as recited in claim 1, wherein each developer of the developing unit comprises a pair of gap rings connected to a shaft of the developing roller and contacting to the photosensitive medium to maintain the predetermined developing gap between the photosensitive medium and the developing roller.

3. The color image forming apparatus as recited in claim 1, further comprising:

a transferring unit comprising a transfer belt as a moving medium of the toner image formed on the photosensitive medium, a first transfer roller transferring the toner image formed on the photosensitive medium to the transfer belt, and a second transfer roller transferring the toner image transferred to the transfer belt to a printing paper;

a fusing unit comprising a pair of transfer rollers to fix the toner image transferred to the printing paper by utilizing heat and pressure; and a paper feeding unit supplying the printing paper to the transferring unit.

4. A color image forming apparatus, comprising:

a photosensitive medium; and developers in a fixed position, each having a developing gap with respect to the photosensitive medium to consecutively develop an image with color toners, wherein the photosensitive medium has a voltage applied thereto to reduce an electric potential between the photosensitive medium and a non-operated developer of at least one of the developers.

5. The color image forming apparatus as recited in claim 4, wherein the developers comprise:

four developers each corresponding to yellow, magenta, cyan, and black toners.

6. The color image forming apparatus as recited in claim 4, wherein the developers develop the image using a developing voltage in a predetermined order of colors.

7. The color image forming apparatus as recited in claim 4, wherein each of the developers comprises:

toner containers, each comprising a color toner, a developing roller rotatably disposed at openings of the toner containers, a toner supplying roller disposed to make contact with the developing roller, and a control blade to maintain a predetermined depth of a toner layer formed on the developing roller.

8. The color image forming apparatus as recited in claim 4, further comprising:

a voltage switching unit supplying a high voltage to consecutively operate the developers in a predetermined order to supply the color toners to the photosensitive medium to form the image on a printing paper.

9. The color image forming apparatus as recited in claim 8, wherein the high voltage switching unit supplies the high voltage to the developing roller and the toner supplying roller of one of the developers that is in a developing operation and simultaneously blocks the high voltage from flowing into other developers that are not in the developing operation.

10. The color image forming apparatus as recited in claim 9, wherein the photosensitive medium is supplied with a predetermined plus voltage to reduce an electric potential between the photosensitive medium and the non-operated developer.

11. The color image forming apparatus as recited in claim 9, wherein the developing operation is performed in an order of yellow, magenta, cyan, and black colors.

12. The color image forming apparatus as recited in claim 4, further comprising:

a plus voltage supplying unit supplying a predetermined plus voltage to the photosensitive medium.

13. The color image forming apparatus as recited in claim 4, wherein the laser scanning electric potential of the grounded photosensitive medium is maintained at +40V.

14. The color image forming apparatus as recited in claim 4, wherein the developers consecutively supply the color toners in a fixed state during the developing operation to solve problems of noise generation and poor development and transfer of the image due to the periodical contact of the photosensitive medium with the developing roller and to guarantee higher image quality.

15. A color image forming apparatus, comprising:

a photosensitive medium;

a light exposure unit converting an electrical signal of an image data to be formed to an optical signal and projecting the converted optical signal to the photosensitive medium to form an electrostatic latent image by utilizing an electric potential difference;

a developing unit comprising developers each having developing rollers and toner-supplying rollers to develop the electrostatic latent image on the photosensitive medium with color toners, wherein the developers are fixed near the photosensitive medium where each developing roller maintains a developing gap with respect to the photosensitive medium;

a high voltage switching unit supplying the developing rollers and the toner supplying rollers with a high voltage during a developing operation, wherein the high voltage is consecutively supplied to each of the developers in an order of colors where the development of the electrostatic image is performed consecutively in respective colors; and a compensation voltage supplying unit supplying the photosensitive medium with a compensation voltage to reduce an electric potential difference between the photosensitive medium and the developing rollers of the developers to which the high voltage is not supplied during the developing operation, wherein toner particles of a toner image formed on the photosensitive medium are not attracted to the developing rollers of the developers to which the high voltage is not supplied.

16. The color image forming apparatus as recited in claim 15, wherein the compensation voltage is a positive (+) voltage when the toner is a negative (−) toner.

17. The color image forming apparatus as recited in claim 15, wherein the compensation voltage is a negative (−) voltage when the toner is a positive (+) toner.

18. A color image forming apparatus, including a light source, a photosensitive medium having an electrically charged layer to generate an electric potential difference upon exposure to the light source at an electrically charged area of the layer, and a light exposure unit to form an electrostatic latent image on the photosensitive medium by utilizing the electric potential difference, the apparatus comprising:

a plurality of developers, each having color toner supplied developing rollers to maintain a predetermined developing gap with the photosensitive medium, so as to develop the electrostatic latent image on the photosensitive medium;

a high voltage switching unit to individually and consecutively supply the developing rollers with a high voltage in an appropriate order to form the electrostatic image such that, during a color image forming operation, one of the developers is operated and the remaining developers are non-operated; and a plus voltage-supplying unit to supply the photosensitive medium with a plus(+) voltage to reduce an electric potential difference between the photosensitive medium and the non-operated developers such that a toner image and/or the electrostatic image of different colors formed on the photosensitive medium is not attracted to the developing rollers of the non-operated developers.

19. A color image forming apparatus, including a light source, a photosensitive medium having an electrically charged layer to generate an electric potential difference upon exposure to the light source at an electrically charged area of the layer, and a light exposure unit to form an electrostatic latent image on the photosensitive medium by utilizing the electric potential difference, the apparatus comprising:

a plurality of developers, each having color toner supplied developing rollers to maintain a predetermined developing gap with the photosensitive medium, so as to develop the electrostatic latent image on the photosensitive medium;

a high voltage switching unit to individually and consecutively supply the developing rollers with a high voltage in an appropriate order to form the electrostatic image such that, during a color image forming operation, one of the developers is operated and the remaining developers are non-operated; and a compensation voltage supplying unit to supply the photosensitive medium with a compensation voltage to reduce an electric potential difference between the photosensitive medium and the non-operated developers such that toner particles of a toner image formed on the photosensitive medium are not attracted to the developing rollers of the non-operated developers.

* * * * *